US007823245B2

(12) United States Patent
Firouzman

(10) Patent No.: US 7,823,245 B2
(45) Date of Patent: Nov. 2, 2010

(54) CLEANING AND SCOURING GLOVE

(76) Inventor: Tomer Firouzman, 4148 Tarrybrae Ter., Tarzana, CA (US) 91356

( * ) Notice: Subject to any disclaimer, the term of this patent is extended or adjusted under 35 U.S.C. 154(b) by 855 days.

(21) Appl. No.: 11/697,787

(22) Filed: Apr. 9, 2007

(65) Prior Publication Data

US 2008/0244848 A1 Oct. 9, 2008

(51) Int. Cl.
*A47K 7/02* (2006.01)
*A47L 13/12* (2006.01)

(52) U.S. Cl. ..... 15/227; 15/118; 2/161.6

(58) Field of Classification Search ..... 15/118, 15/227; 2/161.6
See application file for complete search history.

(56) References Cited

U.S. PATENT DOCUMENTS

| | | | | |
|---|---|---|---|---|
| 2,880,436 | A * | 4/1959 | Hayden | 15/118 |
| 3,151,333 | A | 10/1964 | Scholz | |
| 3,643,386 | A | 2/1972 | Grzyll | |
| 3,885,249 | A | 5/1975 | De Brabander | |
| 4,038,787 | A | 8/1977 | Bianchi | |
| 4,051,572 | A | 10/1977 | Greenwood | |
| D256,184 | S | 8/1980 | Kupperman et al. | |
| D268,968 | S | 5/1983 | Sami | |
| 4,621,388 | A | 11/1986 | Ortolivo | |
| 5,127,976 | A | 7/1992 | McLeish et al. | |
| 5,419,014 | A | 5/1995 | Piantedosi | |
| 5,441,355 | A | 8/1995 | Moore | |
| 5,632,948 | A | 5/1997 | Moore | |
| 5,682,612 | A * | 11/1997 | Schwarz | 2/161.6 |
| D398,086 | S | 9/1998 | Ferdenzi | |
| 5,956,770 | A | 9/1999 | Dennis | |
| 6,000,060 | A | 12/1999 | Borucki-Mastej | |
| 6,016,571 | A | 1/2000 | Guzman et al. | |
| 6,018,837 | A | 2/2000 | Andreu | |
| 6,098,234 | A | 8/2000 | Jackson, Jr. | |
| 6,275,995 | B1 | 8/2001 | Le Gette et al. | |
| 6,513,998 | B1 * | 2/2003 | Barry | 401/7 |
| 6,604,244 | B1 | 8/2003 | Leach | |
| 7,210,171 | B2 * | 5/2007 | Jacobs et al. | 2/160 |
| 2005/0060786 | A1 | 3/2005 | Ran | |
| 2005/0177965 | A1 | 8/2005 | Edoh | |
| 2007/0277288 | A1 | 12/2007 | Sing et al. | |

FOREIGN PATENT DOCUMENTS

| | | | |
|---|---|---|---|
| GB | 2113977 | * | 8/1983 |

* cited by examiner

*Primary Examiner*—Laura C Guidotti
(74) *Attorney, Agent, or Firm*—Kelly Lowry & Kelley, LLP

(57) ABSTRACT

A cleaning glove includes a waterproof glove body having a front surface, including a palm portion, and multiple finger stalls cooperatively joined together to fit a wearer's hand. A water absorbent material is bonded onto a front surface of at least one finger stall. Preferably, the water absorbent material is bonded onto the front surface of each finger stall, as well as the palm portion of the glove body. An abrasive type scouring material is bonded onto the front surface so as to be adjacent to the water absorbent material, typically substantially surrounding the periphery of the water absorbent material.

10 Claims, 3 Drawing Sheets

CLEANING AND SCOURING GLOVE

BACKGROUND OF THE INVENTION

The present invention generally relates to waterproof gloves of the type used for cleaning. More particularly, the present invention relates to a cleaning and scouring glove having sponge and abrasive material thereon for cleaning purposes.

Many of today's existing technologies of scrubbing brushes and similar cleaning devices have awkward shapes and limited flexibility. Bathtubs, tiles in bathrooms, sinks, and even dishes, for example, have hard to reach spaces and often awkward shapes. Existing scrub brushes tend to have the bristles set on a hard surface which makes the overall brush inflexible, therefore very hard if not impossible to bend and flex to reach the awkward shapes and clean hard to reach spaces.

All of these cleaning devices require the user to grip them independently with their hands. A shortcoming associated with this is that the device has a tendency of slipping or falling out of the user's hand when cleaning. Another shortcoming with this is that when a user grips on to this device to clean a surface, extra pressure is required on the part of the user to scrub and clean the surface because of the added force needed to hold on to this device while at the same time applying sufficient pressure to clean a surface.

It is not uncommon when cleaning a surface, such as dishes and silverware, that there is hard and encrusted material to be removed. Often times, the user is cleaning the article with a washcloth, sponge or the like. In such a case, such material is not abrasive and will not remove such hardened residue. Thus, often times the user will scratch or pick at the debris so as to remove it, such as picking at debris on a dish to remove it. The user's fingers are quite small and can apply a fair amount of pressure so as to dislodge and remove such debris, and the fingernail is of sufficient hardness so as to perform the job. However, what will often times happen is that the fingernail will become broken in the process, or the debris lodged between the finger and the fingernail, both of which are highly undesirable.

In order to protect their skin from the soap, and other drying and harsh chemicals, many individuals wear waterproof gloves, such as gloves made out of latex or rubber material. However, such material is not sufficiently abrasive, nor does it retain the soapy water, in order to remove dirt, debris and hardened material from the article to be washed. However, gloves having abrasive material thereon are not in and of themselves new.

For example, there are many United States patents which disclose gloves having abrasive material fixed thereon. For example, U.S. Pat. No. 3,643,386 to Grzyll discloses an abrasive hand apparel. U.S. Pat. No. 3,885,249 to De Brabander discloses a working glove having burring material thereon for grinding, sanding, polishing, etc. U.S. Pat. No. 4,038,787 to Bianchi discloses a glove having abrasive units fixed thereon. U.S. Pat. Nos. 4,051,572; 3,151,333 and U.S. Publication 2005/0177965 A1 all disclose waterproof scrubbing gloves having abrasive material fixed thereon.

There are other prior art references which disclose gloves having removable abrasive material pads. For example, U.S. Pat. Nos. 5,956,770; 6,098,234; and 6,604,244 as well as United States Patent Application Publication No. US 2005/0060786 A1 all disclose gloves having fastening means such as hook and loop fasteners, for removably attaching an abrasive pad or the like.

However, such gloves have certain limitations. One of the primary limitations is that the abrasive material does not retain the soapy water. Thus, the full cleaning and scrubbing action of the abrasive material is not realized as it is well known that the water and cleaning agent (soap) is often times necessary to properly clean the item and remove the hard residue. Another problem with such gloves is that due to the fact that the abrasive pad is removably attached, during hard scrubbing and the like it can become dislodged from the glove with fairly minimal force.

Thus, the shortcomings of these prior art cleaning gloves has been the lack of physical flexibility, that is their incapacity to act as a sponge in order to accomplish the absorption and retention of detergents and solution, and the single cleaning purpose thereof, that is, cleaning of the surface for which a given cleaning abrasive glove may be used.

U.S. Pat. No. 5,419,014 discloses a waterproof flexible glove having reservoirs on the fingers and palms which act to retain cleansing solutions by the surface tension of the cleaning solutions. However, the formation of the reservoirs do not act as an abrasive material so as to scour and scrub, but rather are comprised of the same soft and flexible material of the glove itself.

U.S. Pat. No. 6,016,571 to Guzman et al. disclose a pair of waterproof gloves, wherein one of the gloves has an abrasive scrubbing material affixed on a front surface thereof, whereas the other glove has a sponge material affixed onto a front surface thereof. In this manner, the one hand can be used as a sponge to wipe and clean surfaces, while the other glove can be used as a scouring pad so as to remove more hardened and difficult residue. However, this arrangement also suffers drawbacks. First, similar to the gloves described above, the abrasive glove is not capable of retaining sufficient water and detergent therein, so as to properly clean. Moreover, the glove having the sponge material on the surfaces thereof renders it very difficult to grasp and hold on to items, such as glass dishes and the like.

U.S. Pat. No. 6,018,837 to Andreu discloses a cleaning and scouring glove wherein the fingers of the glove are coated with an abrasive material. A sponge material is affixed to the palm portion of the glove. However, once again, this glove suffers the same drawbacks as the gloves discussed above, namely, the failure to provide sponge material in immediate proximity to the scrubbing material so as to supply the scrubbing material with a source of water and detergent. Thus, while the palm portion of the glove can be used as a sponge to wipe away films and loose material, the abrasive fingers must be immersed in water or the like in order to properly clean and scour.

Accordingly, there is a continuing need for a waterproof glove which serves both as a water absorbing and providing device as well as a scrubbing and scouring device. The present invention fulfills these needs, and provides other related advantages.

SUMMARY OF THE INVENTION

The present invention resides in a cleaning glove which is designed and configured so as to place water absorbent sponge-like material in immediate proximity to abrasive type scouring material so as to provide sufficient gripability of articles, as well as a supply of water and suds to the abrasive material to perform an adequate cleaning job.

The cleaning glove generally comprises a waterproof glove body including a front surface, having a palm portion, and a back surface. Multiple finger stalls, typically four finger stalls and a thumb stall, are cooperatively joined together to fit a wearer's hand. A water absorbent material is bonded onto a front surface of at least one finger stall. An abrasive type scouring material is bonded onto the front surface of the at least one finger stall so as to be adjacent to the water absorbent material. Typically, the abrasive type scouring material substantially surrounds the water absorbent material.

In one form, the water absorbent material extends substantially the length of the at least one finger stall. The abrasive type scouring material surrounds a substantial periphery of the water absorbent material. Although such an arrangement may be formed on a single finger, more typically this arrangement is on all of the finger and thumb stall front surfaces.

In another form of the invention, the water absorbent material comprises multiple patches bonded onto the front surface of at least one finger stall in spaced relation. The abrasive type scouring material substantially surrounds each patch of water absorbent material. Preferably, such an arrangement is formed on the front surface of each of the finger stalls and the thumb stall.

In a particularly preferred embodiment, a water-absorbing material is bonded onto the palm portion of the glove as well. An abrasive type scouring material is bonded onto the palm portion immediately adjacent to the water absorbent material. This may be done with a water absorbent material bonded onto a central portion of the palm portion of the glove, with the abrasive type scouring material substantially surrounding the water absorbent material. In another form, the water absorbent material comprises multiple patches bonded onto the palm portion in spaced relation. The abrasive type scouring material substantially surrounds each of the water absorbent material patches.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
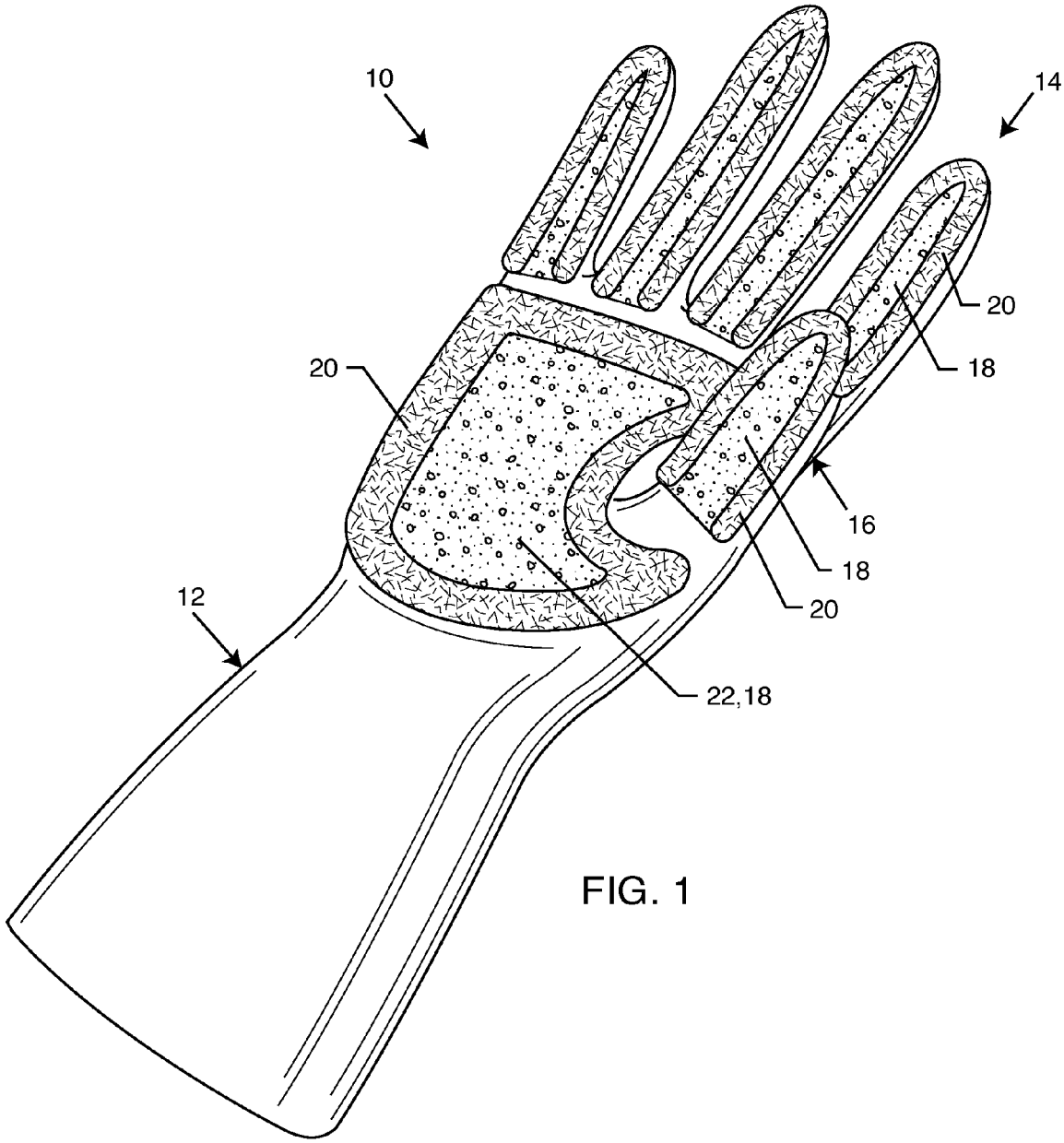
FIG. 1 is a front perspective view of a cleaning glove embodying the present invention.

As shown in the accompanying drawings, for purposes of illustration, the present invention resides in a cleaning glove, generally referred to by the reference number 10, which not only provides a waterproof glove, but a scrubbing abrasive type scouring material and sponge material so as to eliminate the need of using a glove, a scrubber and a sponge, separately, to wash articles, such as dishes.

With reference now to FIGS. 1-4, the cleaning glove 10 generally comprises a waterproof glove body 12, such as those comprised of rubber, latex, or similar materials typically used in association with dishwashing gloves and the like. The glove body 12 includes a front surface, illustrated in FIGS. 1 and 3, and a back surface, illustrated in FIG. 2. Multiple finger stalls 14 are cooperatively joined together with the glove body 12 such that the glove body fits a wearer's hand. Typically, one of the finger stalls comprises a thumb stall 16 adapted for a user to fit his or her thumb therein. Of course, it will be appreciated by those skilled in the art that the glove body 12 is a unitary structure comprised of the rubber or latex-like material.

A water absorbent material 18 is bonded onto a front surface of the glove body 12, and more particularly at least to a front surface of at least one finger stall 14. Such water absorbent material typically comprises a sponge material, such as an open-cell sponge material or the like which is capable of retaining a soapy water mixture, and releasing at least a portion of the soapy water mixture upon application of pressure thereto, similar to cleaning sponges used in the kitchen.

Figure 2:
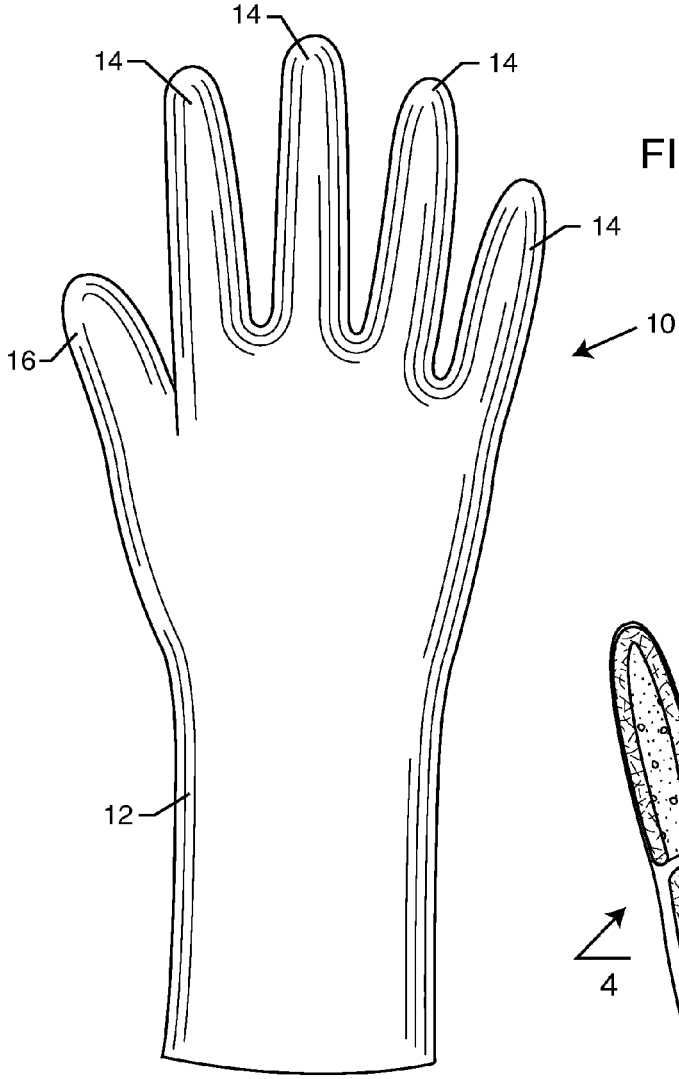
FIG. 2 is an elevational view of a back surface of the glove of FIG. 1.
Figure 3:
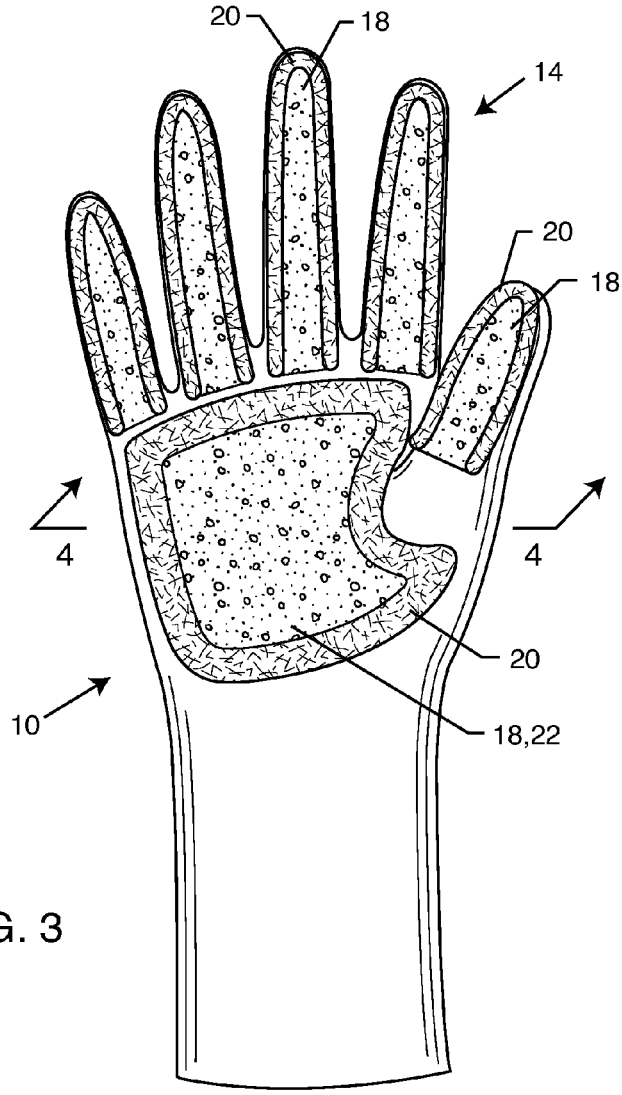
FIG. 3 is a front elevational view of the glove of FIG. 1.

In the embodiment illustrated in FIGS. 1-3, the water absorbent sponge material 18 extends substantially the length of the at least one finger stall 14. More preferably, however, the water absorbent material 18 extends substantially the length of each finger stall 14 as well as the thumb stall 16. An abrasive type scouring material 20 is bonded onto the front surface of the at least one finger stall 14 so as to be adjacent to the water absorbent material 18. The abrasive type scouring material can be of any suitable type which can adequately scrub and scour articles, such as dishes. Typically, the abrasive type scouring material 20 is comprised of a non-woven reticulated (fibrous) polyester foam material. Such material is commonly known as Scotchbrite™, which functions well in scrubbing and scouring caked-on grime and grit, owing to its generally coarsely open-celled texture (75%-90% intersticial void areas, variable by manufacturing process). Of course, other similar scrubbing and scouring abrasive materials may be incorporated into the invention.

As illustrated in FIGS. 1-3, it is preferred that the abrasive type scouring material 20 substantially surround the water absorbent material 18. Moreover, it is preferable that the abrasive type scouring material 20 be positioned towards the fingertips of the finger stalls 14. It is a natural inclination of individuals doing dishes to pick and scrub at caked-on grit and grind using their fingertips. Moreover, the fingertips can reach into indentations, small crevices, etc. which may otherwise not be readily accessible by the entire hand, large scrubbers and sponges, and the like.

As described above, abrasive type scouring materials, due to their large intersticial void areas, do not retain water. Of course, it is well known that it is more effective to scrub caked-on grime and grit and dirt and the like when it is wet and exposed to soapy water with suds. In the present invention, due to the fact that the abrasive type scouring material 20 is disposed immediately adjacent to the water absorbent material 18, typically surrounding the water absorbent material 18, the water absorbent material retains the soap-laden water therein, and when pressure is applied releases the suds and water into the abrasive type scouring material and onto the caked-on grit to be removed.

Figure 4:
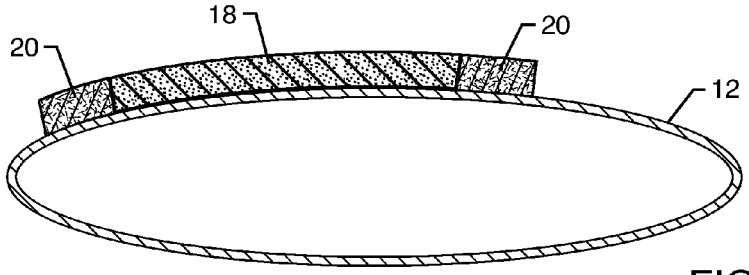
FIG. 4 is a cross-sectional view taken generally along line 4-4 of FIG. 3.

With particular reference to FIG. 4, it will be seen that the sponge material 18 is directly affixed, adhered, or otherwise bonded to the waterproof glove body 12. Similarly, the abrasive type scouring material 20 is bonded onto the rubber, latex, or other waterproof material comprising the glove body 12, and placed immediately adjacent to the periphery of the water absorbent material 18. In this manner, the retained water-cleansing solution can quickly and immediately bleed into the surrounding abrasive type scouring material 20 to enhance the cleaning effect.

In a particularly preferred embodiment, a palm portion 22 of the front surface of the glove body 12 has water absorbent material bonded thereto, as illustrated in FIGS. 1 and 3. The size and configuration of the water absorbent material can vary. However, the abrasive type scouring material 20 typically surrounds the absorbent material 18 on the palm area 22. This enables the entire front surface of the glove body 12 to act as a sponge/scrubber when cleaning articles, such as dishes. Thus, a fairly large area of the dish can be simultaneously wiped and scrubbed clean. Similar to that described above, the water absorbent material 18 retains the cleaning solution therein, which is released and conveyed, at least in part, to the surrounding abrasive type scouring material 20 when washing and scrubbing dishes as pressure is applied thereto.

Preferably, there is a space between the water absorbent material 18 and abrasive type scouring material 20 at the lower end of each finger stall 14 and thumb stall 16 and the abrasive scouring material 20 surrounding the palm area 22. This is to provide sufficient dexterity and flexibility to the user while wearing the glove 10. Such spacing can be clearly seen in FIGS. 1 and 3. Typically, the back surface of the glove body 12, as illustrated in FIG. 2, does not include any water absorbent material or abrasive type scouring material bonded thereto, although the invention is not limited to such.

Another advantage of having the water absorbent material 18 and abrasive scouring-type material 20 placed immediately adjacent to one another on the front surface of the glove body 12 is that it is typically easier to grip and grasp dishes and other articles compared to cleaning gloves which only have sponge material, which can be quite slippery.

Although both the right and left gloves could have the arrangements described herein with water absorbent material and abrasive type scouring material bonded thereto, it is contemplated by the present invention that sets of glove bodies 12 be sold with only either the right or left glove having water absorbent material 18 and abrasive type scouring material 20 bonded thereto, in accordance with the teachings of the invention. The other glove would not have water absorbent material or abrasive type scouring material bonded thereto in the event that the user found such materials cumbersome when grasping, gripping and otherwise manipulating the article to be cleaned. In such case, the glove not having any of the water absorbent material or abrasive type scouring material bonded thereto would enable the user to more easily grasp, grip, turn, etc. the dish or other article to be cleaned, while the glove 10 having the water absorbent material 18 and abrasive type scouring material 20 bonded thereto could be used as the cleaning implement.

Figure 5:
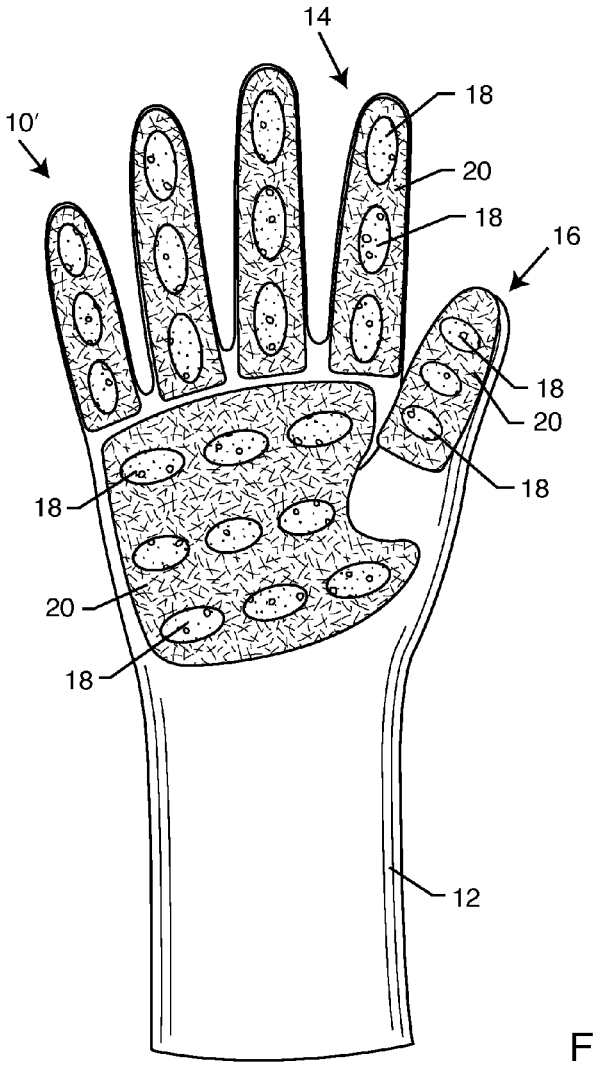
FIG. 5 is a front elevational view of another cleaning glove embodying the present invention.
Figure 6:
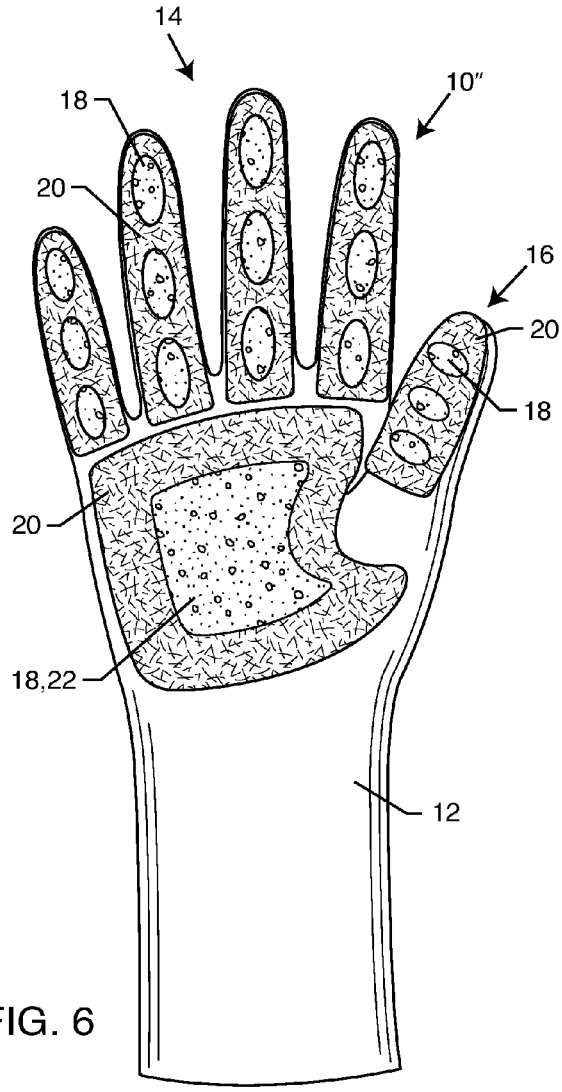
FIG. 6 is a front elevational view of yet another cleaning glove embodying the present invention.

With reference now to FIGS. 5 and 6, it will be appreciated by those skilled in the art that other arrangements and configurations of water absorbent material 18 and abrasive type scouring material 20 are within the scope of this application, provided that the water absorbent material and abrasive type scouring material are placed immediately adjacent to one another, typically with the abrasive type scouring material 20 completely surrounding the water absorbent material 18.

For example, as illustrated in FIG. 5, multiple patches of water absorbent material 18 may be bonded onto the front surface of one or more of the finger and thumb stalls 14 and 16, with abrasive type scouring material 20 surrounding the water absorbent material patches 18. The gloves 10' and 10" of FIGS. 5 and 6 both illustrate this arrangement. It will be appreciated that this arrangement still provides the benefits described above as the water absorbent material 18 is still immediately adjacent to the scouring and scrubbing material 20, and thus able to supply moisture and cleaning solution thereto.

In the glove 10" illustrated in FIG. 6, the water absorbent material 18 is bonded to the central palm portion 22 of the glove body 12. Abrasive type scouring material 20 substantially, preferably completely, surrounds the water absorbent material 18. Aside from the benefits described above, it is also contemplated by the invention that a user could clench his or her fist, which would impart moisture, suds, cleaning solution, etc. from the palm portion water absorbent material pad 18 to the water absorbent material 18 bonded to the finger stalls 14 and 16, as well as the abrasive type scouring material 20.

With reference again to FIG. 5, it is also contemplated by the present invention that the water absorbent material 18 comprise multiple patches bonded onto the palm portion in spaced relation to one another, similar to that of the front surfaces of the finger stalls 14, with the abrasive type scouring material 20 substantially surrounding each water absorbent material patch 18. This still provides the benefit of a source of moisture and cleaning solution, while enlarging the abrasive type scouring material area to enhance scrubbing and scouring ability of the glove 10'.

It will be appreciated by those skilled in the art that the cleaning glove of the present invention eliminates the need of using waterproof gloves, a separate scrub, and a separate sponge, to wash articles, such as dishes. The present invention also provides enhanced gripping action of the glove as the sponge water absorbent material 18 is substantially surrounded by abrasive type scouring material 20. Furthermore, by placing the water absorbent material 18 and the abrasive type scouring material 20 adjacent to one another, moisture, cleaning solution, suds and the like can be easily and quickly imparted to the scrubbing material to facilitate removal of caked-on dirt, grime, etc.

Although several embodiments have been described in some detail for purposes of illustration, various modifications may be made without departing from the scope and spirit of the invention. Accordingly, the invention is not to be limited, except as by the appended claims.

What is claimed is:

1. A cleaning glove, comprising:

a waterproof glove body including a front surface, including a palm portion, a back surface, and multiple finger stalls cooperatively joined together to fit a wearer's hand;

a water absorbent material bonded onto a front surface of at least one finger stall;

an abrasive type scouring material bonded onto the front surface of the at least one finger stall so as to be adjacent to the water absorbent material;

wherein water absorbent material is bonded onto the palm portion, and abrasive type scouring material bonded onto the palm portion immediately adjacent to the water absorbent material; and wherein the water absorbent material comprises multiple patches bonded onto the palm portion in spaced relation, and the abrasive type scouring material substantially surrounds the water absorbent material patches.

2. The cleaning glove of claim 1, wherein the abrasive type scouring material substantially surrounds the water absorbent material.

3. The cleaning glove of claim 1, wherein the water absorbent material extends substantially the length of the at least one finger stall, and the abrasive type scouring material surrounds a substantial periphery of the water absorbent material.

4. The cleaning glove of claim 1, wherein the water absorbent material comprises multiple patches bonded onto the front surface of at least one finger stall in spaced relation, the abrasive type scouring material substantially surrounding each patch of water absorbent material.

5. The cleaning glove of claim 1, wherein the multiple finger stalls comprise at least one finger stall and a thumb stall.

6. The cleaning glove of claim 5, wherein the at least one finger stall and the thumb stall include a water absorbent material bonded onto the front surface, and substantially surrounded by the abrasive type scouring material.

7. The cleaning glove of claim 6, wherein the finger stall comprises four finger stalls, the front surface of each finger stall having the water absorbent material bonded thereon, and substantially surrounded by the abrasive type scouring material.

8. A cleaning glove, comprising:

a waterproof glove body including a front surface, including a palm portion, a back surface, four finger stalls and a thumb stall cooperatively joined together to fit a wearer's hand;

a water absorbent material bonded onto a front surface of each of the finger stalls, thumb stall, and palm portion;

an abrasive type scouring material bonded onto the front surface of each of the finger stalls, thumb stall and palm portion so as to substantially surround the water absorbent material;

wherein the water absorbent material comprises multiple patches bonded onto the palm portion in spaced relation, and the abrasive type scouring material substantially surrounds the water absorbent material patches.

9. The cleaning glove of claim 8, wherein the water absorbent material extends substantially the length of the finger stalls, and the abrasive type scouring material surrounds a substantial periphery of the water absorbent material.

10. The cleaning glove of claim 8, wherein the water absorbent material comprises multiple patches bonded onto the front surface of the finger stalls in spaced apart relation, the abrasive type scouring material substantially surrounding each patch of water absorbent material.

* * * * *